United States Patent [19]

Dalton

[11] 4,394,011

[45] Jul. 19, 1983

[54] AUTOMATIC CARD OR TAG DELIVERY APPARATUS

[75] Inventor: Michael L. Dalton, New Canaan, Conn.

[73] Assignee: Dalton Systems, Inc., Wilton, Conn.

[21] Appl. No.: 294,810

[22] Filed: Aug. 20, 1981

[51] Int. Cl.[3] ..... B65H 3/08

[52] U.S. Cl. ..... 271/107; 271/14; 271/30 A

[58] Field of Search ..... 271/14, 107, 30 A

[56] References Cited

U.S. PATENT DOCUMENTS 3,269,724 8/1966 Lefief ..... 271/107

3,797,822 3/1974 Anderson ..... 271/107 X

*Primary Examiner*—Richard A. Schacher

*Attorney, Agent, or Firm*—B. P. Fishburne, Jr.

[57] ABSTRACT

A linear air cylinder drives a guided slide block or carriage on which is pivotally mounted a vacuum arm biased by a spring to a down horizontal position. Cam followers carried by crank arms on the pivoted vacuum arm engage fixed stops when the rod of the air cylinder is retracted to swing the vacuum arm to an upright tag pickup position. Tags stored in a hopper are transported one at a time to a horizontal position away from the hopper where they are attached to socks.

7 Claims, 5 Drawing Figures

AUTOMATIC CARD OR TAG DELIVERY APPARATUS

BACKGROUND OF THE INVENTION

The objective of the present invention is to provide a simple and reliable precision apparatus for delivering cards or tags one at a time from a supply hopper to a position where each tag or card can be attached by conventional means to a pair of socks or like articles.

A further object of the invention is to improve and simplify the general type of delivery apparatus shown in U.S. Pat. No. 3,287,011.

SUMMARY OF THE INVENTION

Essentially, the delivery apparatus comprises a horizontal support plate having mounted on one end portion thereof a hopper for cards or tags which are vertically held resting on their lower edges in horizontally stacked relationship. Dependingly supported on the support plate is a horizontal guideway for a slide block or carriage driven by the rod of a horizontal pneumatic cylinder. Pivotally mounted on the top of the slide block for vertical swinging is a vacuum arm having short crank arms carrying cam followers which engage fixed stops when the rod or the pneumatic cylinder is retracted. This engagement swings the vacuum arm to an upright position above the support plate and against the force of a spring which biases the arm to a normal horizontal position below the support plate when the rod of the cylinder is extended to its rest position. Vacuum cups of the vacuum arm pick up vertical cards one at a time from the hopper and rotate them ninety degrees to a horizontal position while the cards are transported to a position away from the hopper where each card may be attached to a pair of socks or the like.

DETAILED DESCRIPTION

Figure 1:
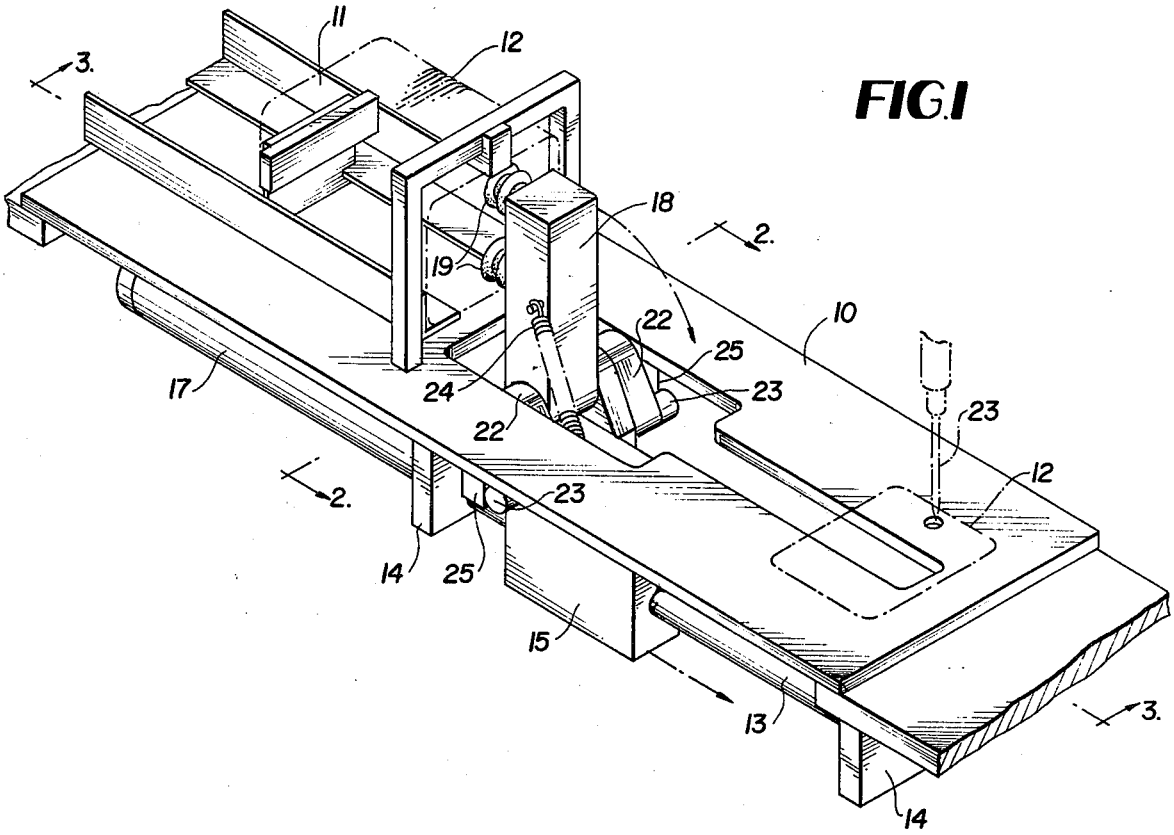
FIG. 1 is a perspective view of an automatic card delivery apparatus according to the invention.
Figure 2:
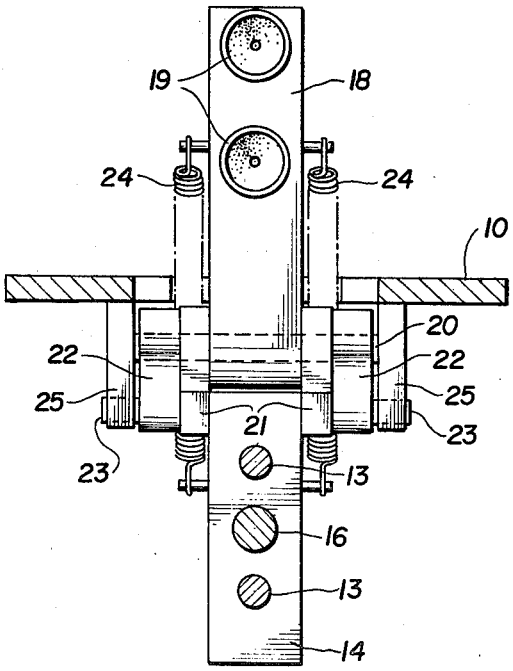
FIG. 2 is a transverse vertical section taken on line 2—2 of FIG. 1.

Referring to the drawings in detail wherein like numerals designate like parts, the numeral 10 designates a fixed horizontal support plate having mounted on one end portion thereof a conventional hopper structure 11 for vertically disposed cards or tags 12 resting on their lower edges in horizontally stacked relationship.

Beneath the support plate in spaced parallel relationship thereto is a linear guideway composed of two parallel guide rods 13 fixedly supported at their ends on vertical plates 14 which depend from the support plate 10.

Slidably mounted on the rods 13 for linear movement horizontally is a carriage block 15 connected to and driven forwardly and rearwardly by the piston rod 16 of a single horizontal pneumatic cylinder 17 operated by a state-of-the-art compressed air logic system, not shown in the drawings. The cylinder 17 has its forward end fixed to the depending plate 14.

A vacuum arm 18 including a pair of spaced vacuum cups 19 is pivotally mounted through a transverse horizontal pivot shaft 20 between support bearings 21 of the block 15.

Short crank arms 22 fixed on the shaft 20 of the vacuum arm 18 carry at their outer ends cam followers 23. The crank arms 22 and vacuum arm 18 travel with the block 15 along the guide rods 13 under influence of piston rod 16.

Figure 5:
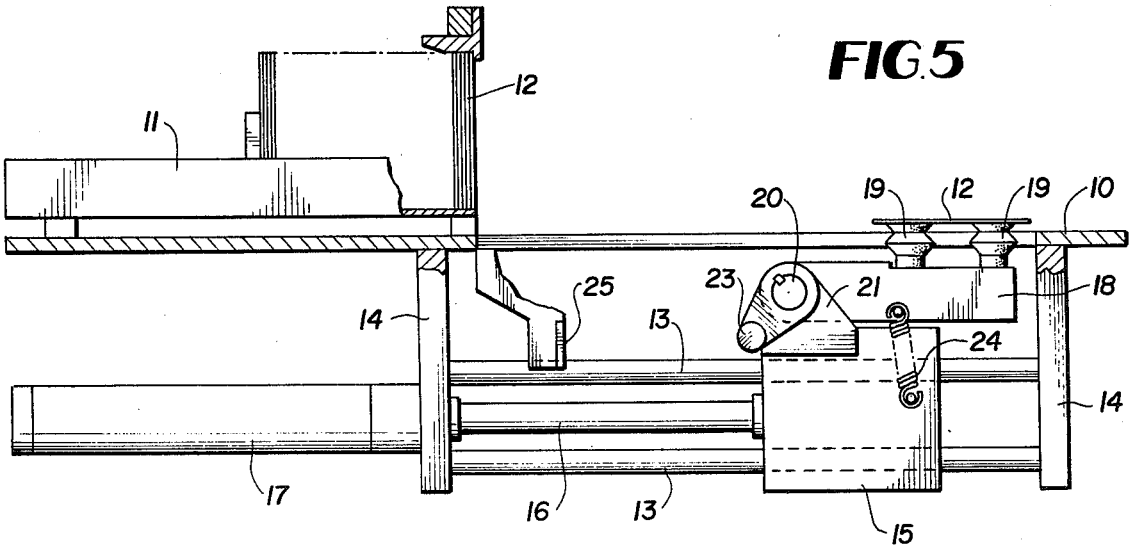

A retractile spring 24 on each side of the vacuum arm 18 is connected between the arm and carriage block 15 and biases the vacuum arm toward the horizontal position shown in FIG. 5 which is the rest position of the carriage block 15 and piston rod 16.

Figure 3:
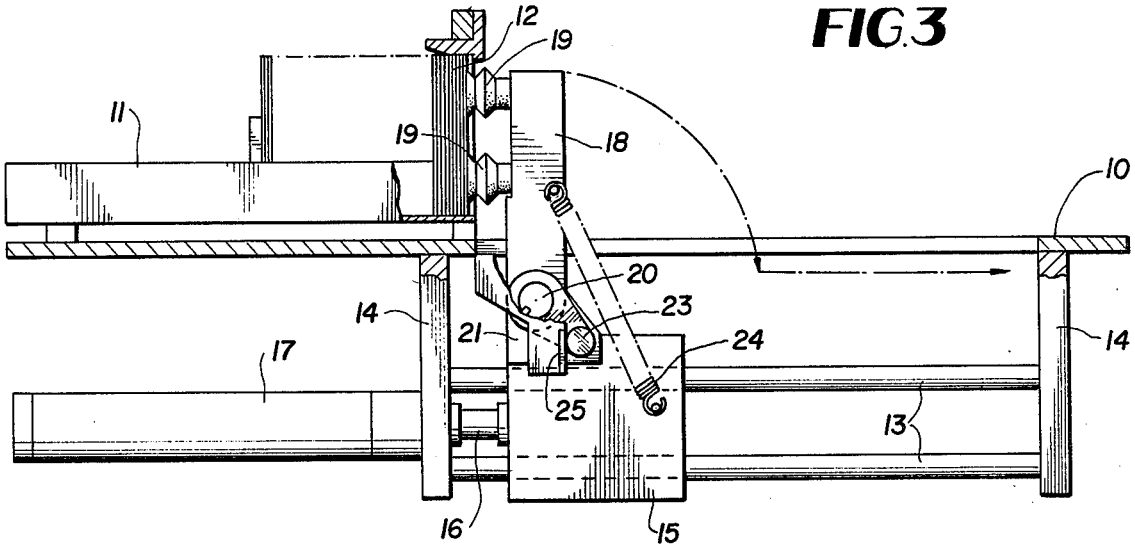
FIG. 3 is a longitudinal vertical section taken on line 3—3 of FIG. 1.
Figure 4:
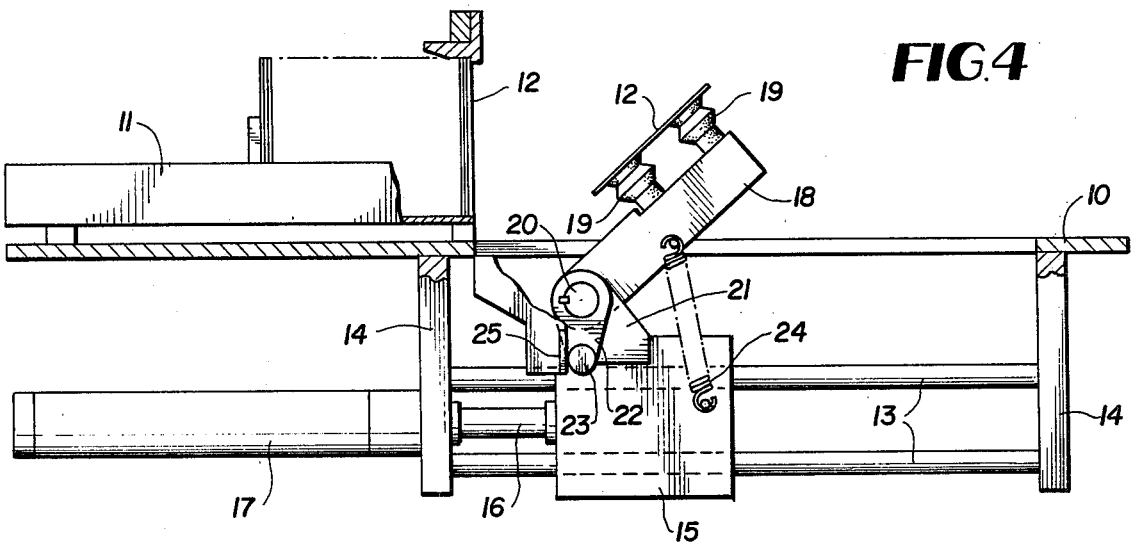
FIGS. 4 and 5 are views similar to FIG. 3 showing intermediate and rest positions of the vacuum card transport arm and its carriage and associated elements.

Fixed rigid stops 25 in the paths of movement of follower elements 23 are engaged by these elements, FIGS. 3 and 4, during retraction of the carriage block 15 to swing the vacuum arm 18 upwardly on the axis of pivot shaft 20 to the vertical card pickup position of FIG. 3.

The overall cycle of operation of the apparatus is as follows. With the carriage block 15 in the normal rest position and the vacuum arm 18 horizontally disposed, FIG. 5, the transported card 12 held by the suction cups 19 is attached to socks, not shown, in a conventional manner utilizing a conventional means 26, FIG. 1.

Through the operation of the conventional logic system for the apparatus, suction being supplied to the cups 19 is de-energized to release the card 12 and the pneumatic cylinder 17 is activated to retract the carriage block 15 toward the hopper 11. The vacuum arm 18 remains in the horizontal position, FIG. 5, until elements 23 engage fixed stops 25. At this instant, the arm 18 begins to swing counterclockwise on the axis of shaft 20 toward the intermediate position of FIG. 4 and finally to the vertical card pickup position of FIG. 3. The biasing spring 24 is stretched to accommodate this movement of the vacuum arm 18. Upon reaching a point of full retraction, FIG. 3, vacuum supplied to the cups 19 is reactivated to enable the picking up of the frontmost vertical card 12 in the hopper 11. After a brief time delay interval, the cylinder 17 drives the carriage block 15 forwardly to the rest position shown in FIG. 5. During this return movement, as follower elements 23 begin to slide over and separate from the stops 25, the springs 24 begin to return the arm 18 to the horizontal rest position, and this will occur prior to the time that the rod 16 is fully extended. The arm 18 will remain horizontal during the rest of the travel of the block 15 to the position of FIG. 5 where the transported card or tag 12 is attached to socks and vacuum to the cups 19 is interrupted prior to beginning a new cycle of operation.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A delivery apparatus for cards or tags comprising a substantially level support plate, a hopper structure for a stack of vertical cards on one end portion of the support plate, a linear guideway in fixed parallel relationship to the support plate below the support plate, a carriage element movably engaged with said guideway, a linear power actuator connected with said carriage element to drive it in opposite directions on the guideway, a vacuum arm means pivotally attached to the carriage element on a transverse horizontal pivot axis and having attached crank arm means, a spring biasing the vacuum arm means toward a level rest position when the carriage element is at the other end portion of the support plate, and a fixed stop in the path of movement of said crank arm means at an intermediate part of the support plate and engaging the crank arm means to swing the vacuum arm means to a substantially vertical position above the support plate in opposition to said spring, whereby the vacuum arm means can pick up a vertical card from said hopper structure and swing the card to a level position while transporting the card to said rest position where the card can be attached to an article.

2. A delivery apparatus for cards or tags as defined in claim 1, and said linear power actuator comprising a power cylinder having an extensible and retractable piston rod connected to the carriage element and being parallel to said linear guideway.

3. A delivery apparatus for cards or tags as defined in claim 2, and rigid support means for said guideway and power cylinder dependingly secured to the support plate.

4. A delivery apparatus for cards or tags as defined in claim 1, and the vacuum arm means comprising an arm body portion and at least one vacuum cup carried by one side of the arm body portion.

5. A delivery apparatus for cards or tags as defined in claim 1, and said fixed stop comprising a vertical stop plate, and the crank arm means including an end follower element cammingly engaging the vertical stop plate.

6. A delivery apparatus for cards or tags as defined in claim 1, and said guideway comprising a pair of spaced parallel guide bars, the carriage element comprising a block having parallel openings receiving said guide bars.

7. A delivery apparatus for card-like elements comprising supporting means, a hopper for card-like elements on the supporting means, a horizontal guideway dependingly secured to the supporting means, a carriage element engaged movably on the guideway, power drive means connected with the carriage element, a vacuum arm pivotally attached near the top of the carriage element and being swingable to and from upright and horizontal positions, spring means interconnecting the carriage element and vacuum arm and biasing the vacuum arm to the horizontal position, a crank extension on the vacuum arm below the pivot axis of the vacuum arm, and a fixed abutment on the supporting means in the path of movement of the crank extension and engaging such extension during movement of the carriage element toward the hopper to swing the vacuum arm to the upright position against the force of the spring means so that the vacuum arm is in opposing relationship to card-like elements in the hopper and can transport a card from a vertical position in the hopper to a horizontal position away from the hopper at which position the card can be attached to an article.

* * * * *